US006025016A

United States Patent [19]

Serfass et al.

[11] Patent Number: 6,025,016

[45] Date of Patent: Feb. 15, 2000

[54] BINDER LAYERS WHICH CAN BE DRIVEN OVER AND PROCESS FOR THE PREPARATION THEREOF

[75] Inventors: Jean-Pierre Serfass, Vineuil Saint Firmin; Jacques Samanos, Villecresnes; Hervé Tessonneau, Dardilly, all of France

[73] Assignee: Screg, Boulogne-Billancourt, France

[21] Appl. No.: 08/927,493

[22] Filed: Sep. 11, 1997

[30] Foreign Application Priority Data

Sep. 13, 1996 [FR] France ..... 96 11213

[51] Int. Cl.[7] ..... B05D 5/10

[52] U.S. Cl. ..... 427/138; 427/136; 427/322; 427/407.1

[58] Field of Search ..... 427/136, 407.1, 427/138, 322

[56] References Cited

U.S. PATENT DOCUMENTS

| | | | |
|---|---|---|---|
| 3,898,349 | 8/1975 | Kehr et al. | 427/136 |
| 4,025,476 | 5/1977 | Miller et al. | 427/136 |
| 4,203,878 | 5/1980 | Bauer | 427/136 |

*Primary Examiner*—Janyce Bell
*Attorney, Agent, or Firm*—Larson & Taylor

[57] ABSTRACT

The subject of this invention is a binder layer which can be driven over for pavements composed of a primary binder film and of an opaque aqueous protective layer capable of reflecting luminous radiation which covers the surface of the said binder film.

17 Claims, No Drawings

BINDER LAYERS WHICH CAN BE DRIVEN OVER AND PROCESS FOR THE PREPARATION THEREOF

The invention relates to a binder layer which can be driven over for pavements and to a process for the preparation thereof. This binder layer which can be driven over is composed of a primary binder film, such as a tack coat, a seal coat or a binder membrane, covered with an aqueous protective composition.

Pavements are currently surfaced in two stages: an adhesive layer, made of a bituminous binder or one of coal origin, known as the tack coat, is first applied to the pavement and then a bituminous mix is spread over the tack coat.

In practice, the bituminous mix is not spread immediately after the adhesive layer is applied to the surface. This technique of the prior art thus exhibits the major disadvantage of leaving the binder applied to the pavement in contact with the tires of processing machinery and of site vehicles, which inescapably causes the binder to be carried off, the latter adhering partly and momentarily to the tires.

Thus, the binder is very quickly found to be distributed unevenly over the surface and it is often observed that the binder is completely absent from certain places. This situation also causes the surroundings of the work site to become spattered.

The invention makes it possible to overcome these various disadvantages by providing for the application, on top of the binder film, of an aqueous composition which forms the protective layer. The binder film, thus covered, can be driven over while guaranteeing the adhesion of the binder to the existing surface and the cleanliness of the work site.

Furthermore, the invention relates to a process for producing pavement surfacings using the binder layers which can be driven over of the invention.

More specifically, the invention relates to a binder layer which can be driven over for pavements composed of a primary binder film and of an opaque aqueous protective layer capable of reflecting luminous radiation which covers the surface of the said binder film.

A white or light-coloured protective layer is particularly appropriate. The aqueous protective layer can be a solution, an emulsion or alternatively can be provided in the form of an aqueous suspension or of a gel.

The opaqueness results from the presence of one or more opaque constituents which are selected from thickeners, inorganic fillers and organic fillers.

These constituents are preferably white or light in colour.

To evaluate the brightness, reference is made to the L*, a*, b* representation system defined in 1986 by the Commission Internationale de l'Eclairage [International Commission on Illumination] (CIE publication, 15-2, colorimetry), in which the brightness L* is evaluated according to a scale from 0 to 100.

The aqueous protective layer advantageously brings about an improvement in brightness of at least 25, preferably at least 30, L* units with respect to the binder film to which it is applied.

The constituents of the protective layer are additionally chosen so as to impart to it the necessary consistency for the latter not to flow but to remain in place and lastingly to cover the whole surface of the binder layer.

This is the reason why the aqueous protective layer preferably comprises at least one thickener, the latter making possible efficient control of the viscosity of the solution.

Another role of the thickener is to stabilize the composition.

The viscosity of the aqueous composition which forms the protective layer must nevertheless not be too high, so as not to prevent it from being spread over the binder film by conventional techniques for spraying binders or by means of spraying lances.

The aqueous protective laver of the invention preferably exhibits a viscosity of 5 to 1200 mPa.s, preferably of 20 to 200 mPa.s, as measured with a Brookfield rotary viscometer rotating at 60 revolutions per minute at a temperature of between 20 and 25° C.

The protective effect of the aqueous layer which covers the binder film results from several physical phenomena which contributes to limiting the adhesion of the binder to the tires of site vehicles.

Due to its opaqueness, the protective layer reflects luminous radiation, which limits the rise in the temperature of the binder when the latter is exposed to the sun. Thus, the adhesion of the bonding binder to the tires of site machinery is greatly restricted.

Furthermore, the presence of water at the surface of the bonding binder provides additional protection by greatly reducing the adhesiveness of the binder.

Finally, when the protective layer contains inorganic or organic fillers, the latter form a physical screen between the tires of the site machinery and the binder.

According to a preferred embodiment, the aqueous composition which forms the protective layer comprises at least one opaque inorganic or organic filler. When it contains one or more water-insoluble inorganic or organic fillers, the latter are in suspension.

The constituents of the aqueous protective layer also have the role of limiting the evaporation of water.

The exact amount of these constituents which have to be incorporated in the aqueous protective layer is easily determined by a person skilled in the art as a function of the brightness and viscosity objectives mentioned above. It naturally depends on the nature of the constituents.

In the context of the invention, thickener is understood to mean any type of constituent capable of increasing the viscosity of the composition. This definition includes thixotropic agents. Mention may be made, by way of example, of cellulose derivatives (hydroxyethylcellulose, sodium carboxymethylcellulose), derivatives of xanthan gum, derivatives of gum tragacanth, derivatives of gum arabic, starches, polyvinylpyrrolidone and alginates.

According to a particularly preferred embodiment, use is made of an associative thickener, such as a polyurethane, a polyacrylate and a hydrophobically modified cellulose. These associative thickeners are described in the literature.

The inorganic fillers which can be used according to the invention are opaque, preferably white or light in colour. Examples of such inorganic fillers are silica, alumina, light-coloured cements, diatomites, pigments and the light-coloured hydroxides and salts of alkali metals or alkaline-earth metals. Titanium dioxide or calcium hydroxide, which can be employed in the process of the invention in the form or milk of lime, is preferably chosen.

The opaque organic fillers are preferably pulverulent organic polymers or copolymers, such as polyamides, poly (vinyl chloride)s, α-olefin polymers and α-olefin copolymers.

According to a particularly preferred embodiment, the aqueous composition which forms the protective layer comprises, as organic filler, a pulverulent organic polymer or copolymer exhibiting a melting temperature or a softening temperature of between 60 and 110° C., preferably between 70 and 100° C. The advantage resulting from the choice of such an ingredient is a reinforcement of the adhesion and impermeability properties at the time of application of the hot bituminous mix to the binder film which can be driven over of the invention.

This is because hot bituminous mixes are generally applied at a temperature of between 120 and 200° C. and more particularly between 140 and 180° C. At this temperature, carefully selected organic fillers can be caused to melt or to soften, which completes and optimizes the adhesion of the binder film to the bituminous mix.

Such organic polymers are, for example, ethylene/vinyl acetate (EVA) copolymers, ethylene/ethyl acrylate (EEA) copolymers, ethylene/butyl acrylate (EBA) copolymers, polyethylenes and polypropylenes.

The inorganic and organic fillers are preferably used in the form of particulate powders. The size of these particles is not essential according to the invention, provided that the latter are dispersible in the aqueous composition which forms the protective layer.

However, the selection will advantageously be made of powders containing fine particles, at least 70%, preferably at least 80%, of the particles of which exhibit a mean diameter of less than 100 μm, better still less than 80 μm, for example less than 65 μm, all the particles exhibiting a size of less than 200 μm.

When they verify these size conditions, the inorganic or organic fillers can also function as breaking agents. When the primary bonding binder layer is applied to the pavement in the emulsion form, breakdown of the emulsion is necessary after application of the latter, so that the binder film is formed on the existing surface. A common practice requires that, throughout the coating of the pavement surface with the emulsion containing the binder, a breaking agent should be sprayed simultaneously. According to the invention, the breaking agent can be incorporated in the aqueous composition rather than sprayed separately.

The fine inorganic and/or organic fillers resent in the composition advantageously play this role of breaking agent, whatever the exact nature of the emulsion containing the binder and more specifically whatever the exact nature of the surfactant present in the emulsion.

The following table gives, by way of information, preferred ranges of variation in the mean diameter of several types of filler.

| Type of filler | Mean diameter |
|---|---|
| $TiO_2$ | 0.1–1 μm (0.5 μm) |
| Hydrated lime | 10–20 μm |
| Cements | 15–80 μm |
| Limestone | 20–30 μm (25 μm) |
| Diatomites | 35–50 μm |
| Organic polymers | 20–80 μm |

Breaking agents other than the fine inorganic and organic fillers which can be used according to the invention can be added to the aqueous protective composition. These agents are basic compounds ($Na_2CO_3$, KOH, NaOH) when the tack coat emulsion comprises a cationic surfactant and acidic compounds, such as HCl, when the emulsion comprises an anionic surfactant.

According to a particularly advantageous embodiment, the aqueous protective layer comprises one or more highly water-soluble salts of the sodium chloride or potassium chloride type and more generally an alkali metal chloride.

The aqueous protective composition can comprise other additives, such as adhesion agents intended to promote the adhesion of the fillers to the binder and the adhesion with the bitumen of the covering bituminous mix.

The adhesion agents are those commonly used in the art, such as, for example, polyamines, imidazolines and amidoamines. Mention will be made, among the best known, of $C_{12}$–$C_{24}$ polyamines, preferably $C_{16}$–$C_{18}$ polyamines.

The additives inccrporated in the protective layer are selected so as not to affect its brightness. This means that constituents which are black in colour will be avoided.

According to the invention, the exact nature of the binder constituting the primary binder film is not critical and any one of the bituminous binders or binders of coal origin known in the art can be used. Mention may be made, by way of indication, of plain bitumens, direct distillation bitumens, blown bitumens, multigrade bitumens, fluxed bitumens, cutback bitumens, modified bitumens and their mixtures, as well as of coal pitches and tars and their mixtures. It must be understood that the binder film can comprise a mixture of bituminous binder and of binder of coal origin.

Modified bitumen is generally understood to mean, in the art, bitumens modified by addition of one or more polymers, of organic resins, of reclaimed around waste rubber or alternatively of adhesion additives.

According to the invention, the primary binder film, which it is intended to protect by the aqueous composition which forms the protective layer, is either a tack coat within the strict meaning or a seal coat or alternatively a membrane which ensures imperviousness and impermeability and which prevents cracks from reflecting upwards.

Thus, the spray rate of the binder film can vary from 200 to 3,000 g, of dry matter, per $m^2$.

The spray rate of the binder film is determined in a way known per se in accordance with the procedure explained in French Standard NFP 98 275-1.

The aqueous protective layer is distributed, according to the invention, over the primary binder film, preferably at the rate of 10 to 200 g, on a dry basis, per $m^2$.

Furthermore, the invention relates to a process for the preparation of a binder film which can be driven over which comprises the stage which consists in applying an opaque aqueous composition capable of reflecting luminous radiation to a primary binder film, so as to lastingly cover the surface of the said binder film.

The aqueous composition used to cover the surface of the binder film exhibits all the characteristics of the resulting aqueous protective layer.

When the inorganic filler is titanium oxide, the latter is present in the composition preferably in the proportion of at least 1% by weight, better still of at least 10%. When the inorganic filler is calcium hydroxide, the latter is present in the composition preferably in the proportion of at least 2% by weight, better still of at least 10%.

The adhesion agents are preferably present in the aqueous protective composition in the proportion of 0.1% to 10% by weight.

Still by way of indication, the sodium hydroxide and the sodium carbonate which are sometimes used as breaking agents are added to the aqueous composition of the invention in the proportion of at least 0.5% by weight up to approximately 10% by weight.

The aqueous protective composition is advantageously applied to the binder film at the rate of 100 to 1,000 g/$m^2$.

The aqueous protective composition can be applied conventionally by using any one of the distributors known in the art designed for spraying binders or alternatively by using a tank and a lance.

According to a preferred embodiment of the invention, the primary binder film and the aqueous protective composition are applied successively or simultaneously by means of a distributor with several spray bars: this specific embodiment, however, involves the binder being applied in the form of an aqueous emulsion.

Such aqueous emulsions are commonly used in the art. They generally comprise, in addition to the bonding binder, one or more anionic or cationic surfacting agents.

In the case of this specific embodiment the aqueous protective composition comprises one or more basic breaking agents (in the case of emulsions containing a cationic surfactant) or acidic breaking agents (in the case of emulsions containing an anionic surfactant).

However, it is also possible to envisage a process in which the binder is first of all spread over the surface in the form of an emulsion, the emulsion is then broken down by spraying with a breaking agent and, finally, the aqueous protective composition is distributed uniformly on top of the binder film.

In the event of particularly severe weather conditions (very hot weather, significant exposure to the sun) and/or when covering with a bituminous mix can only be carried out after a very long delay, it is desirable, at regular intervals, to cover the surface of the binder film which can be driven over with an aqueous composition, in order for it to continually exhibit a wet protective film on the surface.

The said aqueous composition used for the subsequent wetting is preferably water, to which is optionally added one or more water-soluble salts, such as NaCl and KCl.

According to the last of its aspects, the invention relates to a process for the preparation of road surfacings. This process comprises the stages consisting in:

spraying a primary binder film over the pavement surface;

covering the resulting primary binder film with an opaque aqueous composition capable of reflecting luminous radiation;

if appropriate, evaporating all or part of the water present; and applying a bituminous mix to the pavement which has thus been covered.

Bituminous mixes of all types and of all thicknesses can be applied to the binder film which can be driven over according to the invention. Depending on the thickness and the nature of the bituminous mix, it is advisable to evaporate all or part of the water before application of the bituminous mix. In some cases, the bituminous mix can be applied directly to the binder film which can be driven over without waiting for the water to evaporate.

Surprisingly, it was possible to verify that the application of the aqueous protective composition and thus the presence of organic or inorganic fillers with a residual thickness and even residual moisture content does not form an obstacle to the adhesion of the bituminous mix to the surface of the binder film. This is easily verified by a person skilled in the art by use of the core sampling test, by which the adhesion of the various layers to one another is verified by withdrawing, from the pavement, a core sample with a diameter of 80 to 250 mm. Adhesion is good if the layers remain adhering to one another despite the stresses applied to the surfacing by the diamond set of the core sampler.

The following examples illustrate the invention but are not understood as limiting it.

pp means parts by weight

EXAMPLE 1

This example provides three aqueous suspension formulations which can be used according to the invention for the protection of binder films.

| | |
|---|---|
| Sodium carbonate | 24 pp |
| Titanium oxide | 111 pp |
| Associative polyurethane | 1 pp |
| Water | 875 pp |
| | 1000 pp |

| | |
|---|---|
| Hydrated lime | 100 pp |
| Cellulose thickener | 7 pp |
| Water | 893 pp |
| | 1000 pp |

| | |
|---|---|
| Polyamide (30 $\mu$m) | 23 pp |
| Hydroxyethylcellulose | 5 pp |
| Water | 972 pp |
| | 1000 pp |

EXAMPLE 2

This example relates to a binder film which can be driven over according to the invention composed of a binder film A to which has been applied a white aqueous suspension B.

Layer A: Emulsion containing 60% of residual binder which is a elastomer modified bitumen with a penetration of 105 in the stabilized state.

The application rate is of 500 g, on a dry basis, per $m^2$.

White aqueous suspension B: Formulation 1 as defined in Example 1.

This suspension is applied at a rate of 300 $g/m^2$.

EXAMPLE 3

This example relates to a binder film which can be driven over according to the invention composed of a binder film C to which has been applied a white aqueous suspension D.

Layer C: Emulsion containing 60% of residual binder (penetration 188)

The application rate is of 500 g, of dry matter, per $m^2$.

| | |
|---|---|
| Hydrated lime | 100 pp |
| Hydroxyethylcellulose | 5 pp |
| Water | 895 pp |
| | 1000 pp |

This suspension is applied to the layer C at the rate of 500 $g/m^2$.

It could be observed that the presence of a protective layer on the binder film which can be driven over greatly restricts the rise in temperature in the event of exposure to the sun. Thus, in the case of binder films which can be driven over prepared in Examples 2 and 3, differences of 8 to 12° C.

were measured between the unprotected binder film and the protected binder film after exposure to the sun for several tens of minutes.

EXAMPLE 4

The binder films which can be driven over obtained in Examples 2 and 3 were covered with a 4 cm layer of high stone content thin rolled asphalt.

The resulting pavement surfacings exhibit satisfactory strength. In these surfacings, good adhesion of the binder layer (tack coat) to the rolled asphalt is indeed observed by carrying out the core sampling test.

We claim:

1. Process for producing pavement surfacings comprising the step of applying to a tack coat an opaque aqueous protective layer capable of reflecting luminous radiation.

2. Process according to claim 1, wherein the aqueous protective layer is white or light in color.

3. Process according to claim 1, wherein the aqueous protective layer exhibits a viscosity of 5 to 1200 mPa.s, as measured in a Brookfield rotary viscometer rotating at 60 revolutions per minute.

4. Process according to claim 1, wherein the aqueous protective layer comprises one or more opaque constituents capable of reflecting luminous radiation selected from a thickener, an inorganic filler and an organic filler, the said aqueous protective layer ensuring an improvement in brightness of at least 25, $L^*$ units with respect to the uncoated primary layer, $L^*$ being as defined by the International Commission of Illumination.

5. Process according to claim 1, wherein the aqueous protective layer comprises at least one opaque inorganic or organic filler and at least one thickener.

6. Process according to claim 1, wherein the inorganic filler is calcium hydroxide or titanium oxide.

7. Process according to claim 1, wherein the organic filler is a pulverulent organic polymer or copolymer exhibiting a melting temperature or a softening temperature of between 60 and 100° C.

8. Process according to claim 1, wherein the organic filler is selected from ethylene/vinyl acetate copolymers, ethylene/butyl acrylate copolymers, ethylene/ethyl acrylate copolymers, ethylene/butyl acrylate copolymers, ethylene/ethyl acrylate copolymers, polyethylenes and polypropylenes.

9. Process according to claim 1, wherein the thickener is selected from cellulose derivatives, derivatives of xanthan gum, derivatives of gum tragacanth, derivatives of gum arabic, starches, polyvinylpyrrolidone, alginates, associative polyurethanes and associative polyacrylates.

10. Process according to claim 1, wherein the inorganic filler and the organic filler are present in the form of a particulate powder with a mean diameter of less than 200 $\mu$m, at least 70% of the said particles, exhibiting a mean diameter of less than 100 $\mu$m.

11. Process according to claim 1, wherein the aqueous protective layer additionally comprises one or more adhesion agents and/or one or more acidic or basic breaking agents and/or one or more water-soluble salts.

12. Process according to claim 1, wherein the aqueous protective layer is distributed over the tack coat at the rate of 10 to 200 g, on a dry basis, per $m^2$.

13. Process according to claim 1, wherein the aqueous composition is applied to the tack coat at the rate of 100 to 1000 $g/m^2$.

14. Process according to claim 1, further comprising the step of covering, at least a second time, the tack coat with an aqueous composition to which one or more water soluble salts have optionally been added.

15. Process according to claim 14, wherein the aqueous composition is water to which has optionally been added one or more water-soluble salts.

16. Process for producing pavement surfacings comprising applying a tack coat to a pavement and then spreading a bituminous mix over the tack coat, wherein an opaque aqueous protective layer capable of reflecting luminous radiation is applied to the tack coat before spreading the bituminous mix.

17. Process according to claim 16, wherein all or part of the water contained in said aqueous protective layer is evaporated before application of the bituminous mix.

* * * * *